US010320132B2

(12) United States Patent
Zeng et al.

(10) Patent No.: US 10,320,132 B2
(45) Date of Patent: Jun. 11, 2019

(54) RADIO FREQUENCY CONNECTOR

(71) Applicant: HUAWEI TECHNOLOGIES CO., LTD., Shenzhen, Guangdong (CN)

(72) Inventors: Shaojie Zeng, Chengdu (CN); Lianghui Deng, Chengdu (CN); Zhen Lin, Chengdu (CN)

(73) Assignee: HUAWEI TECHNOLOGIES CO., LTD., Shenzhen (CN)

( * ) Notice: Subject to any disclaimer, the term of this patent is extended or adjusted under 35 U.S.C. 154(b) by 0 days.

(21) Appl. No.: 16/003,268

(22) Filed: Jun. 8, 2018

(65) Prior Publication Data

US 2018/0294609 A1 Oct. 11, 2018

Related U.S. Application Data

(63) Continuation of application No. PCT/CN2016/103211, filed on Oct. 25, 2016.

(30) Foreign Application Priority Data

Dec. 16, 2015 (CN) ..... 2015 2 1050187 U

(51) Int. Cl.
*H01R 24/50* (2011.01)
*H01R 24/40* (2011.01)
(Continued)

(52) U.S. Cl.
CPC ..... *H01R 24/50* (2013.01); *H01R 12/707* (2013.01); *H01R 12/7052* (2013.01);
(Continued)

(58) Field of Classification Search
CPC .... H01R 24/50; H01R 24/40; H01R 12/7052; H01R 12/707; H01R 12/7047;
(Continued)

(56) References Cited

U.S. PATENT DOCUMENTS 5,576,675 A 11/1996 Oldfield
6,340,320 B1 * 1/2002 Ogawa ..... H01R 13/2421 29/511

(Continued)

FOREIGN PATENT DOCUMENTS

CN 102097722 A 6/2011
CN 103414057 A 11/2013

(Continued)

*Primary Examiner* — Harshad C Patel
(74) *Attorney, Agent, or Firm* — Paul Christopher Hashim

(57) ABSTRACT

A radio frequency connector is provided, it includes an outer conductor and an inner conductor including a conductive sleeve and an elastically conductive structure and being in the outer conductor and not contact each other; one end of the conductive sleeve is open and the other end is closed; the elastically conductive structure is disposed inside the conductive sleeve; one end of the elastically conductive structure abuts against the closed end of the conductive sleeve and the other end extends out from the open end part of the conductive sleeve and can move in a height direction of the conductive sleeve; the outer conductor is connected to an antenna PCB and a transceiving PCB; the closed end of the conductive sleeve is welded on the transceiving PCB; and the part, extending out from the open end of the conductive sleeve, of the elastically conductive structure abuts against the antenna PCB.

10 Claims, 13 Drawing Sheets

(51) Int. Cl.

| | |
|---|---|
| ***H01R 12/70*** | (2011.01) |
| ***H01R 13/24*** | (2006.01) |
| ***H01R 13/621*** | (2006.01) |
| ***H01R 43/16*** | (2006.01) |
| *H01R 12/71* | (2011.01) |
| *H01R 13/03* | (2006.01) |
| *H01R 43/20* | (2006.01) |

(52) U.S. Cl.
CPC ..... *H01R 13/2407* (2013.01); *H01R 13/621* (2013.01); *H01R 24/40* (2013.01); *H01R 43/16* (2013.01); *H01R 12/7047* (2013.01); *H01R 12/714* (2013.01); *H01R 13/03* (2013.01); *H01R 13/2471* (2013.01); *H01R 43/205* (2013.01); *H01R 2201/02* (2013.01)

(58) Field of Classification Search
CPC ..... H01R 12/714; H01R 13/2407; H01R 13/621; H01R 13/03; H01R 13/2471; H01R 43/16; H01R 43/205; H01R 2201/02
USPC ..... 439/63, 66, 824
See application file for complete search history.

(56) References Cited

U.S. PATENT DOCUMENTS

| | | | | |
|---|---|---|---|---|
| 6,699,054 | B1 | 3/2004 | Critelli | |
| 6,776,668 | B1 | 8/2004 | Scyoc et al. | |
| 6,979,239 | B1 | 12/2005 | Richard et al. | |
| 7,220,134 | B2 * | 5/2007 | Goodman | H01R 13/2421 439/70 |
| 7,507,110 | B1 * | 3/2009 | Yin | G01R 1/06722 439/482 |
| 7,690,925 | B2 * | 4/2010 | Goodman | H05K 7/1061 361/813 |
| 8,066,536 | B2 * | 11/2011 | Chen | H01R 13/2421 439/824 |
| 8,337,256 | B1 * | 12/2012 | Lin | 439/700 |
| 2002/0081910 | A1 * | 6/2002 | Kihira | H01R 12/7082 439/700 |
| 2002/0160637 | A1 * | 10/2002 | Ishizuka | H01R 13/2421 439/131 |
| 2005/0130507 | A1 * | 6/2005 | Arai | H01R 13/187 439/700 |
| 2013/0069835 | A1 | 3/2013 | Swais et al. | |
| 2015/0270635 | A1 * | 9/2015 | Wollitzer | H01R 13/2421 439/675 |
| 2017/0070003 | A1 | 3/2017 | An et al. | |

FOREIGN PATENT DOCUMENTS

| | | | |
|---|---|---|---|
| CN | 103647182 | A | 3/2014 |
| CN | 204349085 | U | 5/2015 |
| CN | 205319469 | U | 6/2016 |
| EP | 1819018 | A1 | 8/2007 |

* cited by examiner

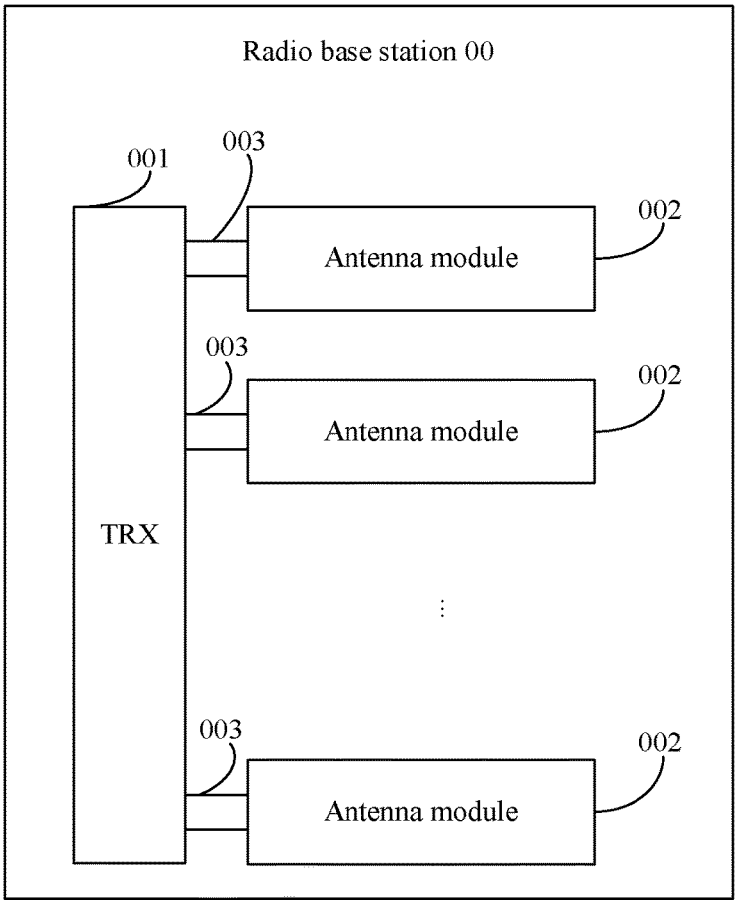
FIG. 1-1
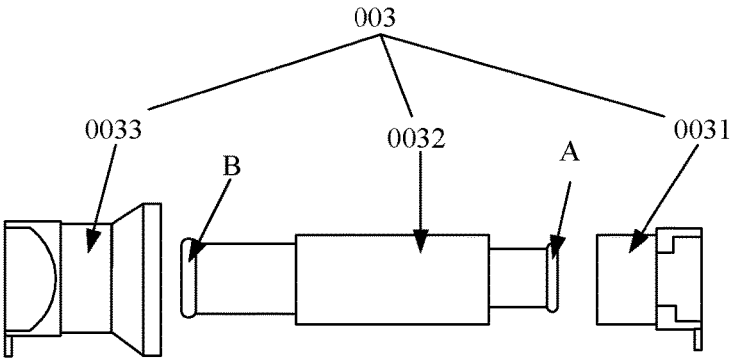
FIG. 1-2 -Prior Art-

RADIO FREQUENCY CONNECTOR

CROSS-REFERENCE TO RELATED APPLICATIONS

This application is a continuation of International Application No. PCT/CN2016/103211, filed on Oct. 25, 2016, which claims priority to Chinese Patent Application No. 201521050187.2, filed on Dec. 16, 2015, The disclosures of the aforementioned applications are hereby incorporated by reference in their entireties.

TECHNICAL FIELD

The present utility model relates to the communications field, and in particular, to a radio frequency connector.

BACKGROUND

A radio base station generally includes multiple antenna modules and one transmission and reception module (TRX for short). The antenna modules are disposed on an antenna printed circuit board (English: Printed circuit board, PCB for short), and the transmission and reception module is disposed on a transceiving PCB. Each antenna module is connected to the transmission and reception module by using a radio frequency connector. Each antenna module and the transmission and reception module can form one communications channel. Each communications channel can transmit and receive signals of one frequency band. In this way, the multiple antenna modules and the transmission and reception module can form multiple communications channels, and therefore the radio base station can transmit and receive signals of multiple frequency bands.

In the prior art, a radio frequency connector generally includes a lock end, a middle rod, and a bowl port. The lock end is welded on a transceiving PCB. The bowl port is welded on an antenna PCB. One end of the middle rod is inserted into a lock hole disposed at the lock end, and the other end of the middle rod is buckled with the bowl port (that is, an opening of the bowl port faces the middle rod). The transceiving PCB and the antenna PCB are connected by using the radio frequency connector, so that an antenna module is connected to a transmission and reception module.

In a procedure of implementing the present utility model, the inventor finds that at least the following problem exists in the prior art:

Because the lock end, the middle rod, and the bowl port are connected by means of insertion and buckling, a case in which alignment cannot be implemented usually occurs in a procedure of insertion and buckling. Consequently, the radio frequency connector is easily damaged.

SUMMARY

To resolve a problem that a radio frequency connector is easily damaged, the present utility model provides a radio frequency connector. The technical solutions are as follows:

The present utility model provides a radio frequency connector, where the radio frequency connector includes:

an outer conductor and an inner conductor, where the inner conductor includes a conductive sleeve and an elastically conductive structure.

The outer conductor is of a tubular structure, the inner conductor is disposed in a cavity of the outer conductor, and the inner conductor is not in contact with the outer conductor. Because the inner conductor is disposed in the cavity of the outer conductor, a configuration height of the radio frequency connector is equivalent to a height of the outer conductor. In embodiments of the present utility model, the height of the outer conductor may be 5.3 mm (millimeter). To meet a configuration height requirement on thinning, the configuration height of the radio frequency connector is required to be maintained at less than 5.5 mm. Because 5.3 mm is less than 5.5 mm, the configuration height of the radio frequency connector provided in the embodiments of the present utility model can meet the configuration height requirement on thinning. Optionally, in the embodiments of the present utility model, the outer conductor may be of a circular tubular structure. The circular tubular structure has an outer diameter of 5 mm. Therefore, in appearance, the radio frequency connector may be of a cylindrical structure whose diameter is equal to 5 mm and whose height is equal to 5.3 mm. In the embodiments of the present utility model, the outer conductor can be implemented by using a shielding cover, and the outer conductor can shield a signal on the inner conductor, and prevent the signal on the inner conductor from being leaked to the exterior of the outer conductor from the interior of the outer conductor. In addition, the outer conductor can be used as a ground to serve as a signal backflow ground. The outer conductor may be made of metal aluminum. The inner conductor can be implemented by using a pogo pin. There is an air medium in a cavity between the outer conductor and the inner conductor.

One end of the conductive sleeve is open, and the other end of the conductive sleeve is closed; the elastically conductive structure is disposed inside the conductive sleeve; one end of the elastically conductive structure abuts against the closed end of the conductive sleeve, and the other end of the elastically conductive structure can extend out from the open end part of the conductive sleeve, and can move in a height direction of the conductive sleeve. The other end of the elastically conductive structure is a free end of the elastically conductive structure.

The outer conductor can be fixedly connected to both an antenna printed circuit board PCB and a transceiving PCB. For example, the outer conductor can be fixedly connected to both an antenna PCB and a transceiving PCB by using screws. In this way, the radio frequency connector can be quickly inserted or unplugged. The closed end of the conductive sleeve can be welded on the transceiving PCB, and a part, extending out form the open end of the conductive sleeve, of the elastically conductive structure can abut against the antenna PCB. For example, a fixing piece is disposed at the closed end of the conductive sleeve, a fixing hole may be disposed on the transceiving PCB, and the fixing piece on the conductive sleeve can be inserted into the fixing hole in the transceiving PCB. After the fixing piece on the conductive sleeve is inserted into the fixing hole in the transceiving PCB, the closed end of the conductive sleeve may be welded on the transceiving PCB by using a through-hole reflow soldering process. Disposing the fixing piece on the conductive sleeve can prevent misalignment between the closed end of the conductive sleeve and a bonding pad on the transceiving PCB caused when the through-hole reflow soldering process is performed. In actual application, the fixing piece may be a welding pin, and the fixing hole may be a welding through hole. After the welding pin on the conductive sleeve is inserted into the welding through hole in the transceiving PCB, the closed end of the conductive sleeve is welded on the transceiving PCB by using a through-hole reflow soldering process, and the embodiments of the present utility model are not limited thereto. In the embodiments of the present utility model, the outer conductor is fixed by using a screw, the inner conductor is fixed by means of welding, a bonding pad is disposed on the antenna PCB, and the part, extending out from the open end of the conductive sleeve, of the elastically conductive structure can abut against the bonding pad of the antenna PCB. Therefore, the bonding pad, as a contact, can implement signal transmission between the transceiving PCB and the antenna PCB, and improve a radial tolerance capability of the radio frequency connector. For example, in the embodiments of the present utility model, the radial tolerance capability of the radio frequency connector is greater than 1.1 mm. After the radio frequency connector is connected to the antenna PCB and the transceiving PCB, the other end of the elastically conductive structure moves in a height direction of the conductive sleeve. Therefore, the elastically conductive structure can absorb a height tolerance from the antenna PCB to the transceiving PCB, and satisfy an axial tolerance for blind mate from a plate (the transceiving PCB) to a plate (the antenna PCB).

Further, one end of the elastic element abuts against the closed end of the conductive sleeve; a bottom end of a conductive head abuts against the other end of the elastic element; and a top end of the conductive head can extend out from the open end part of the conductive sleeve. The other end of the elastic element may be a free end of the elastic element. For example, in the embodiments of the present utility model, the elastic element may be a compression spring.

Further, the conductive head includes a metal inner core and an outer insulation layer.

The metal inner core is of a columnar structure, an included angle a exists between a bottom surface and a side surface of the metal inner core, and a value range of a is $0° < a \leq 90°$.

When a is less than 90°, the outer insulation layer is disposed on the side surface of the metal inner core, a region that is on the side surface of the metal inner core and that is close to the bottom surface of the metal inner core is an exposed region in which the outer insulation layer is not disposed, and the exposed region can be in point contact with an inner wall of the conductive sleeve under an action of the elastic element. The included angle a between the bottom surface and the side surface of the metal inner core is less than 90°, so that the conductive head is in a slightly inclined state in the conductive sleeve after a force is applied on the conductive head, and a stable contact point is formed by the metal inner core and the conductive sleeve.

Because the outer insulation layer is disposed in other regions on the metal inner core than the exposed region, the other regions are not electrically conductive with the conductive sleeve; a signal on the conductive sleeve can be transmitted to the metal inner core through a contact point between the exposed region of the metal inner core and the conductive sleeve. The outer insulation layer may be made of a non-conductive dielectric material, or the outer insulation layer may be a non-conductive insulation film, and the embodiments of the present utility model are not limited thereto. For example, a forming material of the outer insulation layer includes but is not limited to either polytetrafluoroethylene (PTFE for short) or polyetheretherketone (PEEK for short). A forming process of the outer insulation layer may include spraying or embedding, that is, spraying a non-conductive material on a surface of the metal inner core, or embedding an insulation material in a surface of the metal inner core by using an embedding process. For example, in the embodiments of the present utility model, the elastic element is an inductor. Because a direct-current signal and a low frequency signal can be transmitted through an inductor, and a high frequency signal cannot be transmitted through an inductor, a may be designed to less than 90°, so that the conductive head is in an inclined state in the conductive sleeve after a force is applied on the conductive head, and a stable contact point is formed between the metal inner core and a side wall of the conductive sleeve. When a is less than 90°, the radio frequency connector provided in the present utility model can be applied to a direct-current signal and an alternating-current signal whose frequency is less than 6 GHz (1 billion hertz). For example, a high frequency alternating-current signal, a low frequency alternating-current signal, or a direct-current signal on the conductive sleeve is transmitted to the conductive head through the contact point of the conductive sleeve and the conductive head. It should be noted that, 6 GHz in the embodiments of the present utility model is only used as an example. In actual application, the radio frequency connector provided in the present utility model can also be applied to transmission of an alternating-current signal whose frequency is equal to or higher than 6 GHz, and the present utility model is not limited thereto. In actual application, the conductive sleeve includes a sleeve body, and a solid layer and a reinforced conductive layer that are successively disposed on a surface of the sleeve body. A high frequency alternating-current signal is transmitted along the reinforced conductive layer on the surface of the conductive sleeve.

It should be noted that, in the embodiments of the present utility model, to reduce passive intermodulation (PIM for short) of the radio frequency connector, it is required that a transmission path of a signal is unique and a contact point is reliable. In the embodiments of the present utility model, setting an included angle a to less than 90° can ensure that the contact point is unique and reliable, so as to ensure uniqueness of a signal path. For example, in the embodiments of the present utility model, the PIM of the radio frequency connector is less than −100 dBm@2*27 dBm, where −100 dBm@2*27 dBm means that a multiplication spectral power generated when two signals whose powers are 27 dBm (decibel-milliwatt) are input is −100 dBm.

When a is equal to 90°, the outer insulation layer is disposed on both the bottom surface and the side surface of the metal inner core, and the conductive head and the conductive sleeve are coupled for signal transmission.

When a is equal to 90°, the outer insulation layer is disposed on both the bottom surface and the side surface of the metal inner core. In this case, the conductive head is in contact with the conductive sleeve, but the conductive head is not electrically conductive with the conductive sleeve; and the conductive head and the conductive sleeve can be coupled for signal transmission. The outer insulation layer may be made of a non-conductive dielectric material, or the outer insulation layer may be a non-conductive insulation film, and the embodiments of the present utility model are not limited thereto. For example, a forming material of the outer insulation layer includes but is not limited to either polytetrafluoroethylene or polyetheretherketone. A forming process of the outer insulation layer may include spraying or embedding, that is, spraying a non-conductive material on a surface of the metal inner core, or embedding an insulation material in a surface of the metal inner core by using an embedding process. It should be noted that, in the embodiments of the present utility model, the elastic element is an inductor. A direct-current signal and a low frequency signal can be transmitted through an inductor, and a high frequency signal cannot be transmitted through an inductor, but the high frequency signal may be transmitted by means of coupling. Therefore, when a is equal to 90°, the radio frequency connector can be applied to high frequency signals whose frequencies are 1.7 GHz to 6 GHz. The conductive head and the conductive sleeve can be coupled for signal transmission. As a tolerance control capability increases, a gap between the conductive head and the conductive sleeve can be further reduced, and a coupling capacitance can be increased. The radio frequency connector can be used for a high frequency signal whose working frequency is higher than 700 MHz.

It should be noted that, in the embodiments of the present utility model, to reduce the PIM of the radio frequency connector, when a working frequency of a base station is higher than 1.7 GHz, the conductive head and the conductive sleeve can be coupled for signal transmission. In this way, the PIM of the radio frequency connector can be reduced, and stability of signal transmission can be ensured.

It should be additionally noted that the radio frequency connector provided in the embodiments is applied between an antenna module and a TRX for implementing radio frequency connection between the antenna module and the TRX. Powers of the antenna module and the TRX are generally less than 1 W (watt). Because receiving and transmitting are implemented in the same antenna module, the radio frequency connector requires low PIM, and a best method for implementing low PIM is to transmit a signal in a non-contact manner. If a signal needs to be transmitted in a contact manner, contact stability needs to be ensured, and unnecessary contact, especially unstable contact needs to be reduced. According to the embodiments of the present utility model, the PIM of the radio frequency connector can be reduced by setting a to 90° or setting a to less than 90°.

Optionally, the conductive head is of an integrated structure formed by superimposing bottom surfaces of two cylinders having unequal diameters; an axis of the cylinder having a smaller diameter is collinear with an axis of the cylinder having a larger diameter; and a curved surface protrusion is disposed on a bottom surface that is of the cylinder having a smaller diameter and that is not superimposed with the cylinder having a larger diameter.

The conductive sleeve is a cylindrical sleeve, a pressing-rivet opening is disposed at an open end of the conductive sleeve, and one end having a smaller diameter of the conductive head can extend out from the pressing-rivet opening of the conductive sleeve.

When a is less than 90 degrees, it can be considered that an inclined surface protrusion integrated with the cylinder having a larger diameter is disposed, in a superposition manner, on a bottom surface that is of the cylinder having a larger diameter on the conductive head and that is not superimposed with the cylinder having a smaller diameter. Further, the conductive sleeve may be a cylindrical sleeve, and one end having a smaller diameter of the conductive head can extend out from the pressing-rivet opening of the conductive sleeve. It should be noted that, in actual application, to enable the conductive head to fit the pressing-rivet opening, a platform-like structure may further be superimposed between the cylinder having a smaller diameter and the cylinder having a larger diameter. The platform-like structure may be a round platform, and an area of an upper bottom surface of the round platform is equal to an area of a bottom surface of the cylinder having a smaller diameter, and an area of a lower bottom surface of the round platform is equal to an area of a bottom surface of the cylinder having a larger diameter. The pressing-rivet opening can be formed by using a pressing-rivet process, and the pressing-rivet opening is used to prevent an elastically conductive structure from falling off the conductive sleeve.

Further, an axis of the conductive head is collinear with an axis of the conductive sleeve, an inner diameter of the conductive sleeve is D2, a diameter of the cylinder having a larger diameter is D1, and a gap between the cylinder having a larger diameter and the conductive sleeve is D, where D2, D1, and D satisfy a relationship: D=D2−D1.

D2 ranges in a positive tolerance of 0.02 millimeters, D1 ranges in a negative tolerance of 0.02 millimeters. For example, a value range of D is 0.01 to 0.05 millimeters. Optionally, D is equal to 0.01 millimeter.

Further, the metal inner core includes an inner core body, and a solid layer and a reinforced conductive layer that are successively disposed on a surface of the inner core body.

The inner core body is made of a copper alloy material and formed by means of turning processing.

The solid layer is made from phosphorous nickel or high phosphorous nickel and formed by using a chemical generation method.

The reinforced conductive layer is made of a gold material and formed by using an electroplating process.

The inner core body may be made of a copper alloy material and formed by means of turning processing. For example, in the embodiments of the present utility model, the copper alloy material may be brass. The solid layer may be made from phosphorous nickel or high phosphorous nickel and formed by using a chemical generation method, where content of phosphorus in phosphorous nickel is generally 6% to 8%, and content of phosphorus in high phosphorus nickel is generally greater than 8%. Nickel is a material having very high hardness, and nickel can be used to improve stiffness of the metal inner core, but nickel has magnetism. The magnetism affects PIM of the radio frequency connector, and phosphorus can eliminate the magnetism of nickel. Therefore, the solid layer can be made from phosphorous nickel or high phosphorous nickel. In this way, stiffness of the metal inner core can be ensured while the PIM of the radio frequency connector can be reduced. The reinforced conductive layer may be made of a gold material and formed by using an electroplating process. For example, the reinforced conductive layer is made of gold. Because gold has good electrical conductivity and corrosion resistance, using gold to form the reinforced conductive layer can ensure conductivity of the metal inner core, and the metal inner core has corrosion resistance.

Further, the conductive sleeve includes a sleeve body, and a solid layer and a reinforced conductive layer that are successively disposed on a surface of the sleeve body.

The sleeve body is made of a copper alloy material and formed by means of turning processing.

The solid layer is made from phosphorous nickel or high phosphorous nickel and formed by using a chemical generation method.

The reinforced conductive layer is made of a gold material and formed by using an electroplating process.

Surfaces of the sleeve body include an inner surface and an outer surface of the sleeve body. The sleeve body may be made of a copper alloy material and formed by means of turning processing. For example, in the embodiments of the present utility model, the copper alloy material may be brass. The solid layer may be made from phosphorous nickel or high phosphorous nickel and formed by using a chemical generation method, where content of phosphorus in phosphorous nickel is generally 6% to 8%, and content of phosphorus in high phosphorus nickel is generally greater than 8%. Nickel is a material having very high hardness, and nickel can be used to improve stiffness of the conductive sleeve, but nickel has magnetism. The magnetism affects PIM of the radio frequency connector, and phosphorus can eliminate the magnetism of nickel. Therefore, the solid layer may be made from phosphorous nickel or high phosphorous nickel. In this way, stiffness of the conductive sleeve can be ensured while the PIM of the radio frequency connector can be reduced. The reinforced conductive layer may be made of a gold material and formed by using an electroplating process. For example, the reinforced conductive layer is made of gold. Because gold has good electrical conductivity and corrosion resistance, using gold to form the reinforced conductive layer can ensure conductivity of the conductive sleeve, and the conductive sleeve has corrosion resistance.

The technical solutions provided in the present utility model bring the following beneficial effects:

The present utility model provides a radio frequency connector. The radio frequency connector includes an outer conductor and an inner conductor. The inner conductor includes a conductive sleeve and an elastically conductive structure. The outer conductor is of a tubular structure. The inner conductor is disposed in a cavity of the outer conductor, and is not in contact with the outer conductor. One end of the conductive sleeve is open, and the other end of the conductive sleeve is closed. The elastically conductive structure is disposed inside the conductive sleeve. One end of the elastically conductive structure abuts against the closed end of the conductive sleeve, and the other end of the elastically conductive structure can extend out from the open end part of the conductive sleeve, and can move in a height direction of the conductive sleeve. The outer conductor can be fixedly connected to both an antenna printed circuit board PCB and a transceiving PCB. The closed end of the conductive sleeve can be welded on the transceiving PCB, and a part, extending out from the open end of the conductive sleeve, of the elastically conductive structure can abut against the antenna PCB. Because the outer conductor can be fixedly connected to the antenna PCB and the transceiving PCB, and the inner conductor can be welded on the transceiving PCB and abut against the antenna PCB, connection between the transceiving PCB, the radio frequency connector, and the antenna PCB can be implemented without insertion and buckling. Therefore, a problem that a radio frequency connector is easily damaged because alignment cannot be implemented can be avoided, and damage to the radio frequency connector can be reduced.

It should be understood that the foregoing general description and the following detailed description are only used as examples and do not limit the present utility model.

BRIEF DESCRIPTION OF DRAWINGS

To describe the technical solutions in the embodiments of the present utility model more clearly, the following briefly describes the accompanying drawings required for describing the embodiments. Apparently, the accompanying drawings in the following description show merely some embodiments of the present utility model, and a person of ordinary skill in the art may still derive other drawings from these accompanying drawings without creative efforts.

FIG. 1-1 is an application environment diagram in which a radio frequency connector is involved according to an embodiment of the present utility model;

FIG. 1-2 is an exploded view of a radio frequency connector according to the prior art;

FIG. 2 is a schematic structural diagram of a radio frequency connector according to an embodiment of the present utility model;

FIG. 3-1 is a schematic structural diagram of a radio frequency connector according to another embodiment of the present utility model;

FIG. 3-2 is a schematic structural diagram of an inner conductor according to the embodiment shown in FIG. 3-1;

FIG. 3-3 is a diagram of a transmission path of a signal on the inner conductor shown in FIG. 3-2;

FIG. 3-4 is a force analysis diagram illustrated when the inner conductor shown in FIG. 3-2 is in contact with an antenna PCB;

FIG. 3-5 is a schematic structural diagram of another inner conductor according to the embodiment shown in FIG. 3-1;

FIG. 3-6 is a force analysis diagram illustrated when the inner conductor shown in FIG. 3-5 is in contact with an antenna PCB;

FIG. 3-7 is a schematic structural diagram of a conductive head according to the embodiment shown in FIG. 3-1;

FIG. 3-8 is a schematic structural diagram of a conductive sleeve according to the embodiment shown in FIG. 3-1;

FIG. 3-9 is a schematic structural diagram of a conductive head according to the embodiment shown in FIG. 3-1;

FIG. 3-10 is a schematic structural diagram of a metal inner core according to the embodiment shown in FIG. 3-1;

FIG. 3-11 is a schematic structural diagram of a conductive sleeve according to the embodiment shown in FIG. 3-1;

FIG. 4 is a method flowchart of a use method of a radio frequency connector according to an embodiment of the present utility model;

FIG. 5-1 is a method flowchart of a use method of a radio frequency connector according to another embodiment of the present utility model;

FIG. 5-2 is a schematic structural diagram illustrated after an inner conductor is connected to a transceiving PCB according to the embodiment shown in FIG. 5-1;

FIG. 5-3 is a schematic structural diagram illustrated after an outer conductor is connected to a transceiving PCB and an antenna PCB according to the embodiment shown in FIG. 5-1;

FIG. 6-1 is a method flowchart of a method for fabricating a radio frequency connector according to an embodiment of the present utility model; and FIG. 6-2 is a schematic structural diagram illustrated after an elastic element and a conductive head are successively placed inside a conductive sleeve on which a pressing-rivet opening is to be formed according to the embodiment shown in FIG. 6-1.

The drawings herein are incorporated in the specification and constitute a part of the specification, show embodiments conforming to the present utility model, and explain principles of the present utility model together with the specification.

DESCRIPTION OF EMBODIMENTS

To make the objectives, technical solutions, and advantages of the present utility model clearer, the following further describes the present utility model in detail with reference to the accompanying drawings. Apparently, the described embodiments are merely a part rather than all of the embodiments of the present utility model. All other embodiments obtained by a person of ordinary skill in the art based on the embodiments of the present utility model without creative efforts shall fall within the protection scope of the present utility model.

Figures 1, 3:
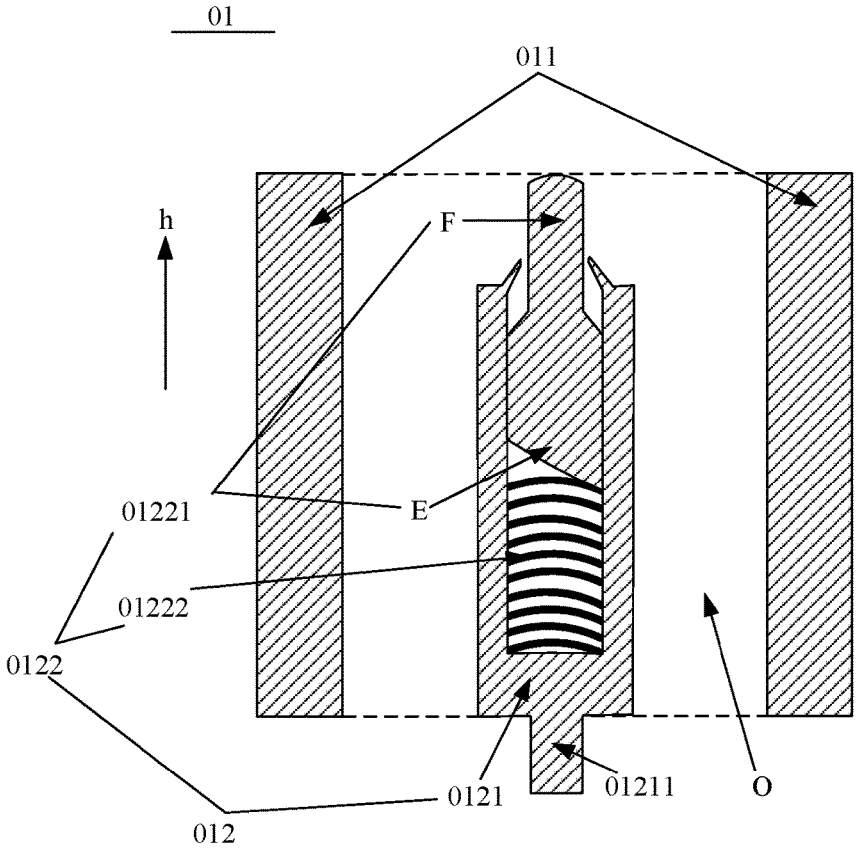
Figures 2, 3:
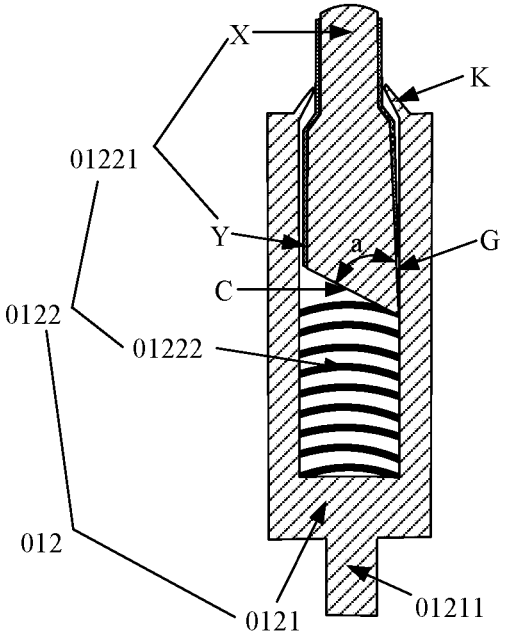
Figure 3:
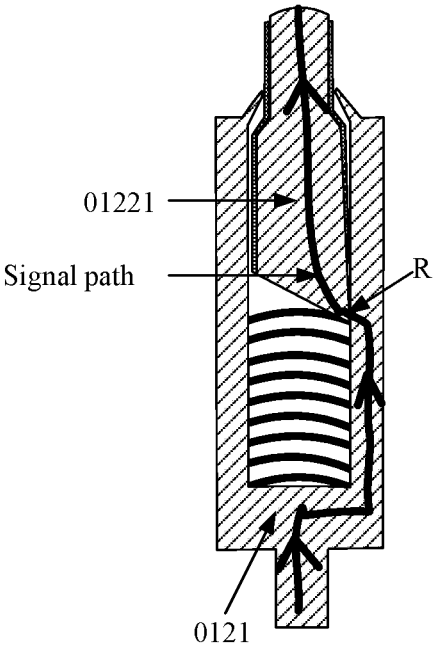

Referring to FIG. 1-1, FIG. 1-1 shows an application environment diagram in which a radio frequency connector is involved according to an embodiment of the present utility model. In the application environment diagram, a radio base station 00 is provided. Referring to FIG. 1-1, the radio base station 00 may include one TRX 001 and multiple antenna modules 002, each antenna module 002 can form a communications channel together with the TRX 001 by using a radio frequency connector 003, and each communications channel can transmit and receive signals of one frequency band.

Figure 2:
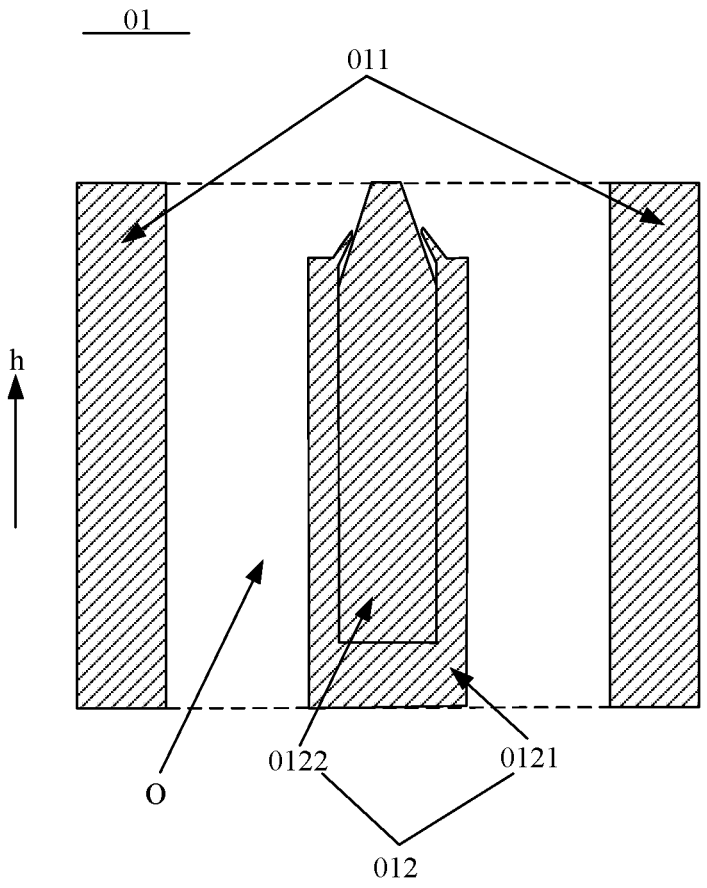

For example, referring to FIG. 1-2, FIG. 1-2 shows an exploded view of a radio frequency connector 003 according to the prior art. Referring to FIG. 1-2, the radio frequency connector 003 includes a lock end 0031, a middle rod 0032, and a bowl port 0033. A lock hole (not shown in FIG. 1-2) is disposed at the lock end 0031. When a TRX and an antenna module are connected by using the radio frequency connector 003, the lock end 0031 is welded on a transceiving PCB (a circuit board of the TRX), the bowl port 0033 is welded on an antenna PCB, and then one end A of the middle rod is inserted into the lock hole of the lock end 0031, the bowl port 0033 is buckled at the other end B of the middle rod, so that connection between the transceiving PCB and the antenna PCB is implemented, and further, connection between the antenna module and the transmission and reception module is implemented. Because the lock end 0031, the middle rod 0032, and the bowl port 0033 are connected by means of insertion and buckling, a case in which alignment cannot be implemented usually occurs in a procedure of insertion and buckling. Consequently, radial tolerance capabilities of the lock end 0031, the middle rod 0032, and the bowl port 0033 are relatively poor, and the radio frequency connector 003 is easily damaged. In addition, because a configuration height of the radio frequency connector 003 is equivalent to a sum of heights of the lock end 0031, the middle rod 0032, and the bowl port 0033, the configuration height of the radio frequency connector 003 is 13 to 19 mm. Generally, to reduce a thickness of an overall structure that is formed after the antenna module is connected to the transmission and reception module, the configuration height of the radio frequency connector is required to be maintained at less than 5.5 mm. However, because the configuration height of the radio frequency connector 003 in the prior art is 13 to 19 mm, compared with a configuration height requirement of 5.5 mm, the configuration height of the radio frequency connector 003 is higher. Therefore, the thickness of the overall structure that is formed by connecting the antenna module to the transmission and reception module by using the radio frequency connector 003 is relatively large. This does not facilitate thinning of the overall structure.

Referring to FIG. 2, FIG. 2 shows a schematic structural diagram of a radio frequency connector 01 according to an embodiment of the present utility model. The radio frequency connector 01 may be used for implementing connection between a TRX and an antenna module. Referring to FIG. 2, the radio frequency connector 01 includes an outer conductor 011 and an inner conductor 012. The inner conductor 012 includes a conductive sleeve 0121 and an elastically conductive structure 0122.

The outer conductor 011 may be of a tubular structure, the inner conductor 012 is disposed in a cavity O of the outer conductor 011, and the inner conductor 012 is not in contact with the outer conductor 011.

One end of the conductive sleeve 0121 is open, and the other end of the conductive sleeve 0121 is closed; the elastically conductive structure 0122 is disposed inside the conductive sleeve 0121; one end of the elastically conductive structure 0122 abuts against the closed end of the conductive sleeve 0121, and the other end of the elastically conductive structure 0122 can extend out from the open end part of the conductive sleeve 0121, and can move in a height direction h of the conductive sleeve 0121. The other end of the elastically conductive structure 0122 is a free end of the elastically conductive structure 0122.

The outer conductor 011 can be fixedly connected to both an antenna printed circuit board PCB (not shown in FIG. 2) and a transceiving PCB (not shown in FIG. 2); the closed end of the conductive sleeve 0121 can be welded on the transceiving PCB, and a part, extending out from the open end of the conductive sleeve 0121, of the elastically conductive structure 0122 can abut against the antenna PCB.

In conclusion, according to the radio frequency connector provided in this embodiment of the present utility model, because an outer conductor can be fixedly connected to an antenna PCB and a transceiving PCB, an inner conductor can be welded on the transceiving PCB and abut against the antenna PCB, connection between the transceiving PCB, the radio frequency connector, and the antenna PCB can be implemented without insertion and buckling. Therefore, a problem that a radio frequency connector is easily damaged because alignment cannot be implemented can be avoided, and damage to the radio frequency connector can be reduced.

Further, because the inner conductor is disposed in a cavity of the outer conductor, a configuration height of the radio frequency connector is equivalent to a height of the outer conductor. Compared with a radio frequency connector in the prior art, the configuration height of the radio frequency connector is relatively small. Therefore, a thickness of an overall structure that is formed by connecting an antenna module to a transmission and reception module is relatively small, so as to facilitate thinning.

Referring to FIG. 3-1, FIG. 3-1 shows a schematic structural diagram of a radio frequency connector 01 according to another embodiment of the present utility model. The radio frequency connector 01 may be used for implementing connection between a TRX and an antenna module. Referring to FIG. 3-1, the radio frequency connector 01 includes an outer conductor 011 and an inner conductor 012.

The outer conductor 011 may be of a tubular structure, the inner conductor 012 is disposed in a cavity O of the outer conductor 011, and the inner conductor 012 is not in contact with the outer conductor 011. Because the inner conductor 012 is disposed in the cavity O of the outer conductor 011, a configuration height of the radio frequency connector 01 is equivalent to a height of the outer conductor 011. In this embodiment of the present utility model, the height of the outer conductor 011 may be 5.3 mm. To meet a configuration height requirement on thinning, the configuration height of the radio frequency connector 01 is required to be maintained at less than 5.5 mm. Because 5.3 mm is less than 5.5 mm, the configuration height of the radio frequency connector 01 provided in this embodiment of the present utility model can meet the configuration height requirement on thinning. Optionally, in this embodiment of the present utility model, the outer conductor 011 may be of a circular tubular structure. The circular tubular structure has an outer diameter of 5 mm. Therefore, in appearance, the radio frequency connector 01 may be of a cylindrical structure whose diameter is equal to 5 mm and whose height is equal to 5.3 mm. In this embodiment of the present utility model, the outer conductor 011 can be implemented by using a shielding cover, and the outer conductor 011 can shield a signal on the inner conductor 012, and prevent the signal on the inner conductor 012 from being leaked to the exterior the outer conductor 011 from the interior of the outer conductor 011. In addition, the outer conductor 011 can be used as a ground to serve as a signal backflow ground. The outer conductor 011 may be made of metal aluminum. The inner conductor 012 can be implemented by using a Pogo pin. There is an air medium in a cavity between the outer conductor 011 and the inner conductor 012.

As shown in FIG. 3-1, the inner conductor 012 includes a conductive sleeve 0121 and an elastically conductive structure 0122. One end of the conductive sleeve 0121 is open, and the other end of the conductive sleeve 0121 is closed; the elastically conductive structure 0122 is disposed inside the conductive sleeve 0121; one end of the elastically conductive structure 0122 abuts against the closed end of the conductive sleeve 0121, and the other end of the elastically conductive structure 0122 can extend out from the open end part of the conductive sleeve 0121, and can move in a height direction h of the conductive sleeve 0121. The other end of the elastically conductive structure 0122 is a free end of the elastically conductive structure 0122.

The outer conductor 011 can be fixedly connected to both an antenna printed circuit board PCB (not shown in FIG. 3-1) and a transceiving PCB (not shown in FIG. 3-1). For example, the outer conductor 011 can be fixedly connected to both an antenna PCB and a transceiving PCB by using screws. In this way, the radio frequency connector can be quickly inserted or unplugged. The closed end of the conductive sleeve 0121 can be welded on the transceiving PCB, and a part, extending out from the open end of the conductive sleeve 0121, of the elastically conductive structure 0122 can abut against the antenna PCB. For example, as shown in FIG. 3-1, a fixing piece 01211 is disposed at the closed end of the conductive sleeve 0121, a fixing hole may be disposed on the transceiving PCB, and the fixing piece 01211 on the conductive sleeve 0121 can be inserted into the fixing hole in the transceiving PCB. After the fixing piece 01211 on the conductive sleeve 0121 is inserted into the fixing hole in the transceiving PCB, the closed end of the conductive sleeve 0121 may be welded on the transceiving PCB by using a through-hole reflow soldering process. Disposing the fixing piece 01211 on the conductive sleeve 0121 can prevent misalignment between the closed end of the conductive sleeve 0121 and a bonding pad on the transceiving PCB caused when the through-hole reflow soldering process is performed. In actual application, the fixing piece 01211 may be a welding pin, and the fixing hole in the transceiving PCB may be a welding through hole. After the welding pin on the conductive sleeve 0121 is inserted into the welding through hole in the transceiving PCB, the closed end of the conductive sleeve is welded on the transceiving PCB by using a through-hole reflow soldering process, and this embodiment of the present utility model is not limited thereto. In this embodiment of the present utility model, the outer conductor 011 is fixed by using a screw, the inner conductor 012 is fixed by means of welding, a bonding pad is disposed on the antenna PCB, and the part, extending out from the open end of the conductive sleeve 0121, of the elastically conductive structure 0122 can abut against the bonding pad of the antenna PCB. Therefore, the bonding pad, as a contact, can implement signal transmission between the transceiving PCB and the antenna PCB, and improve a radial tolerance capability of the radio frequency connector 01. For example, in this embodiment of the present utility model, the radial tolerance capability of the radio frequency connector 01 is greater than 1.1 mm. After the radio frequency connector is connected to the antenna PCB and the transceiving PCB, the other end of the elastically conductive structure 0122 moves in a height direction h of the conductive sleeve 0121. Therefore, the elastically conductive structure 0122 can absorb a height tolerance from the antenna PCB to the transceiving PCB, and satisfy an axial tolerance for a blind-mate connector from a plate (the transceiving PCB) to a plate (the antenna PCB).

Further, still referring to FIG. 3-1, the elastically conductive structure 0122 may include a conductive head 01221 and an elastic element 01222. One end of the elastic element 01222 abuts against the closed end of the conductive sleeve 0121; a bottom end E of the conductive head 01221 abuts against the other end of the elastic element 01222; and a top end F of the conductive head 01221 can extend out from the open end part of the conductive sleeve 0121. The other end of the elastic element 01222 may be a free end of the elastic element 01222. For example, in this embodiment of the present utility model, the elastic element 01222 may be a compression spring.

Optionally, referring to FIG. 3-2, FIG. 3-2 shows a schematic structural diagram of the inner conductor 012 according to the embodiment shown in FIG. 3-1. Referring to FIG. 3-2, the inner conductor 012 includes a conductive sleeve 0121 and an elastically conductive structure 0122. A fixing piece 01211 is disposed at a closed end of the conductive sleeve 0121. The elastically conductive structure 0122 includes a conductive head 01221 and an elastic element 01222. One end of the elastic element 01222 abuts against the closed end of the conductive sleeve 0121; a bottom end of the conductive head 01221 abuts against the other end of the elastic element 01222; and a top end of the conductive head 01221 can extend out from an open end part of the conductive sleeve 0121. For example, as shown in FIG. 3-2, the conductive head 01221 may include a metal inner core X and an outer insulation layer Y. The metal inner core X may be of a columnar structure, and an included angle a exists between a bottom surface and a side surface of the metal inner core X, and a value range of a is $0° < a \leq 90°$. FIG. 3-2 shows a case in which an included angle a exists between the bottom surface and the side surface of the metal inner core X, and the included angle a is less than 90° (degree). The included angle a between the bottom surface and the side surface of the metal inner core X is less than 90°, so that the conductive head 01221 is in a slightly inclined state in the conductive sleeve 0121 after a force is applied on the conductive head 01221, and a stable contact point is formed between the metal inner core X and the conductive sleeve 0121. Referring to FIG. 3-2, the outer insulation layer Y is disposed on a side surface G of the metal inner core X. A region that is on the side surface G of the metal inner core X and that is close to a bottom surface C of the metal inner core X is an exposed region (not marked in FIG. 3-2) in which the outer insulation layer is not disposed. Under an action of the elastic element 01222, the exposed region can be in point contact with an inner wall of the conductive sleeve 0121, and other regions on the metal inner core X can be in contact with the inner wall of the conductive sleeve 0121. However, because the outer insulation layer Y is disposed on the other regions on the metal inner core X, the other regions are not electrically conductive with the conductive sleeve 0121; a signal on the conductive sleeve 0121 can be transmitted to the metal inner core X through a contact point between the exposed region of the metal inner core X and the conductive sleeve 0121. The outer insulation layer Y may be made of a non-conductive dielectric material, or the outer insulation layer Y may be a non-conductive insulation film, and this embodiment of the present utility model is not limited thereto. For example, a forming material of the outer insulation layer Y includes but is not limited to either PTFE or PEEK. A forming process of the outer insulation layer Y may include spraying or embedding, that is, spraying a non-conductive material on a surface of the metal inner core X, or embedding an insulation material in a surface of the metal inner core X by using an embedding process. Referring to FIG. 3-2, it can be learned that, that the bottom end of the conductive head 01221 abuts against the other end of the elastic element 01222 actually means that a bottom end of the metal inner core X abuts against the other end of the elastic element 01222, and this embodiment of the present utility model is not limited thereto. For example, in this embodiment of the present utility model, the elastic element 01222 is an inductor. Because when the inner conductor 012 is an inner conductor shown in FIG. 3-2, the radio frequency connector 01 can be applied to a direct-current signal and an alternating-current signal whose frequency is less than 6 GHz. For example, referring to FIG. 3-3, FIG. 3-3 shows a transmission path of a signal on an inner conductor when the inner conductor 012 is the inner conductor shown in FIG. 3-2. Referring to FIG. 3-3, a high frequency alternating-current signal, a low frequency alternating-current signal, or a direct-current signal on the conductive sleeve 0121 is transmitted to the conductive head 01221 through a contact point R between the conductive sleeve 0121 and the conductive head 01221. It should be noted that 6 GHz in this embodiment of the present utility model is only used as an example. In actual application, the radio frequency connector 01 provided in the present utility model can also be applied to transmission of an alternating-current signal whose frequency is equal to or higher than 6 GHz, and the present utility model is not limited thereto, and FIG. 3-3 is only used as an example. In actual application, the conductive sleeve 0121 includes a sleeve body, and a solid layer and a reinforced conductive layer that are successively disposed on a surface of the sleeve body. A high frequency alternating-current signal is transmitted along the reinforced conductive layer on the surface of the conductive sleeve 0121.

Figures 3, 4:
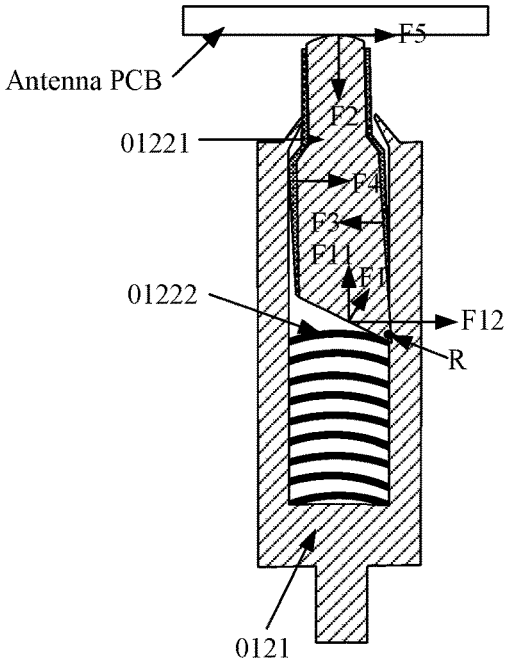

It should be noted that, in this embodiment of the present utility model, to reduce PIM of the radio frequency connector, it is required that a transmission path of a signal is unique and the contact point R is reliable. In this embodiment of the present utility model, setting an included angle a to less than 90° can ensure that the contact point R is unique and reliable, so as to ensure uniqueness of a signal path. For example, as shown in FIG. 3-4, FIG. 3-4 shows a force analysis diagram illustrated when the conductive head 01221 of the inner conductor 012 shown in FIG. 3-2 is in contact with an antenna PCB. Referring to FIG. 3-4, an elastic force F1 is applied by the elastic element 01222 on the conductive head 01221. The elastic force F1 may be decomposed into F11 and F12 shown in FIG. 3-4. A pressure F2 is applied by the antenna PCB on the conductive head 01221, and elastic forces F3 and F4 are applied by the conductive sleeve 0121 on the conductive head 01221. Under an action of the elastic element 01222, a friction force F5 shown in FIG. 3-4 is also applied by the antenna PCB on the conductive head 01221. When the conductive head 01221 is in an equilibrium state, F11=F2, and F3=F12+F4+F5. In this embodiment of the present utility model, F11=F2>100 g can ensure contact reliability between the conductive head 01221 and the antenna PCB; F3=F12+F4+F5>25 g can ensure contact reliability of the contact point R. In this way, the conductive head 01221 does not shake in the conductive sleeve 0121. Therefore, the contact point R between the conductive head 01221 and the conductive sleeve 0121 is unique, and a transmission path of a signal is unique. This can reduce the PIM of the radio frequency connector 01. For example, in this embodiment of the present utility model, the PIM of the radio frequency connector 01 is less than −100 dBm@2×27 dBm, where −100 dBm@2×27 dBm means that a multiplication spectral power generated when two signals whose powers are 27 dBm (decibel-milliwatt) are input is −100 dBm.

Figures 3, 4, 5:
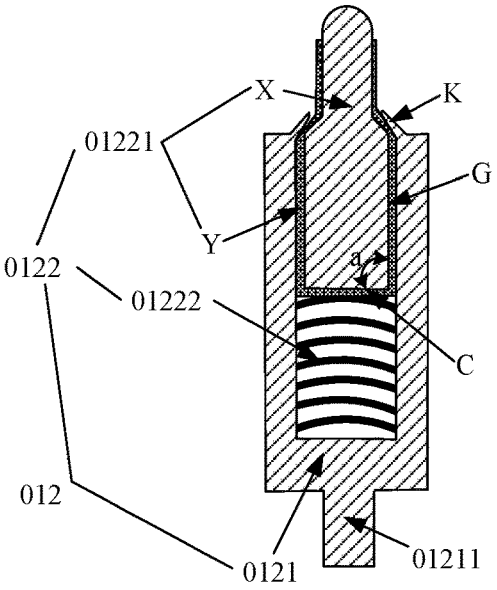

Optionally, referring to FIG. 3-5, FIG. 3-5 shows a schematic structural diagram of another inner conductor 012 according to the embodiment shown in FIG. 3-1. Referring to FIG. 3-5, the inner conductor 012 includes a conductive sleeve 0121 and an elastically conductive structure 0122. A fixing piece 01211 is disposed at a closed end of the conductive sleeve 0121. The elastically conductive structure 0122 includes a conductive head 01221 and an elastic element 01222. One end of the elastic element 01222 abuts against the closed end of the conductive sleeve 0121; a bottom end of the conductive head 01221 abuts against the other end of the elastic element 01222; and a top end of the conductive head 01221 can extend out from an open end part of the conductive sleeve 0121. For example, as shown in FIG. 3-5, the conductive head 01221 may include a metal inner core X and an outer insulation layer Y. The metal inner core X may be of a columnar structure, and an included angle a exists between a bottom surface and a side surface of the metal inner core X, and a value range of a is 0°<a≤90°. FIG. 3-5 shows a case in which an included angle a exists between the bottom surface and the side surface of the metal inner core X, and the included angle a is equal to 90°. Referring to FIG. 3-5, the outer insulation layer Y is disposed on both a bottom surface C and a side surface G of the metal inner core X. In this case, the conductive head 01221 is in contact with the conductive sleeve 0121, but the conductive head 01221 is not electrically conductive with the conductive sleeve 0121, and the conductive head 01221 and the conductive sleeve 0121 can be coupled for signal transmission. The outer insulation layer Y may be made of a non-conductive dielectric material, or the outer insulation layer Y may be a non-conductive insulation film, and this embodiment of the present utility model is not limited thereto. For example, a forming material of the outer insulation layer Y includes but is not limited to either polytetrafluoroethylene or polyetheretherketone. A forming process of the outer insulation layer Y may include spraying or embedding, that is, spraying a non-conductive material on a surface of the metal inner core X, or embedding an insulation material in a surface of the metal inner core X by using an embedding process. Referring to FIG. 3-5, it can be learned that, that the bottom end of the conductive head 01221 abuts against the other end of the elastic element 01222 actually means that the outer insulation layer Y abuts against the other end of the elastic element 01222, and this embodiment of the present utility model is not limited thereto. It should be noted that, in this embodiment of the present utility model, the elastic element 01222 is an inductor. A direct-current signal and a low frequency signal can be transmitted through an inductor, and a high frequency signal cannot be transmitted through an inductor, but the high frequency signal may be transmitted by means of coupling.

Therefore, when the inner conductor 012 is the inner conductor shown in FIG. 3-5, the radio frequency connector 01 can be applied to high frequency signals whose frequencies are 1.7 GHz to 6 GHz. The conductive head 01221 and the conductive sleeve 0121 can be coupled for signal transmission. As a tolerance control capability increases, a gap between the conductive head 01221 and the conductive sleeve 0121 can be further reduced, and a coupling capacitance can be increased. A working frequency of a base station (the radio frequency connector) can be extended to equal or higher than 700 MHz.

It should be noted that, in this embodiment of the present utility model, to reduce the PIM of the radio frequency connector, when a working frequency of the base station is higher than 1.7 GHz, the conductive head 01221 and the conductive sleeve 0121 can be coupled for signal transmission. In this way, the PIM of the radio frequency connector can be reduced, and stability of signal transmission can be ensured. For example, as shown in FIG. 3-6, FIG. 3-6 shows a force analysis diagram illustrated when the conductive head 01221 of the inner conductor 012 shown in FIG. 3-5 is in contact with an antenna PCB. Referring to FIG. 3-6, an elastic force F6 is applied by the elastic element 01222 on the conductive head 01221, and a pressure F7 is applied by the antenna PCB on the conductive head 01221. When the conductive head 01221 is in an equilibrium state, F6=F7. In this embodiment of the present utility model, F6=F7>100 g can ensure contact reliability and stability between the conductive head 01221 and the antenna PCB. This can reduce the PIM of the radio frequency connector 01.

It should be additionally noted that the radio frequency connector provided in this embodiment is applied between an antenna module and a TRX for implementing radio frequency connection between the antenna module and the TRX. Powers of the antenna module and the TRX are generally less than 1 W. Because receiving and transmitting are implemented in the same antenna module, the radio frequency connector requires low PIM, and a best method for implementing low PIM is to transmit a signal in a non-contact manner. If a signal needs to be transmitted in a contact manner, contact stability needs to be ensured, and unnecessary contact, especially unstable contact needs to be reduced. In this embodiment of the present utility model, setting the inner conductor to be in a structure shown in FIG. 3-2 (improving contact stability) or FIG. 3-5 (in a non-contact manner) can reduce the PIM of the radio frequency connector 01.

Optionally, referring to FIG. 3-7, FIG. 3-7 shows a schematic structural diagram of the conductive head 01221 according to the embodiment shown in FIG. 3-1. Referring to FIG. 3-7, the conductive head 01221 may be regarded as an integrated structure formed by superimposing bottom surfaces of two cylinders having unequal diameters. The cylinder having a smaller diameter is a cylinder Z1, and the cylinder having a larger diameter is a cylinder Z2. An axis (not shown in FIG. 3-7) of the cylinder Z1 having a smaller diameter is collinear with an axis (not shown in FIG. 3-7) of the cylinder Z2 having a larger diameter. A curved surface protrusion W is disposed on a bottom surface that is of the cylinder Z1 having a smaller diameter and that is not superimposed with the cylinder Z2 having a larger diameter. When the inner conductor 012 is the inner conductor shown in FIG. 3-2, it can be considered that an inclined surface protrusion Z3 integrated with the cylinder Z2 having a larger diameter is disposed, in a superposition manner, on a bottom surface that is of the cylinder Z2 having a larger diameter on the conductive head 01221 and that is not superimposed with the cylinder Z1 having a smaller diameter. Further, the conductive sleeve 0121 may be a cylindrical sleeve, as shown in FIG. 3-2 or FIG. 3-5, a pressing-rivet opening K is disposed at an open end of the conductive sleeve 0121, and one end having a small diameter of the conductive head 01221 can extend out from the pressing-rivet opening K of the conductive sleeve 0121. It should be noted that, in actual application, to enable the conductive head 01221 to fit the pressing-rivet opening K, as shown in FIG. 3-7, a platform-like structure Z4 may further be superimposed between the cylinder Z1 having a smaller diameter and the cylinder Z2 having a larger diameter. The platform-like structure Z4 may be a round platform, and an area of an upper bottom surface of the round platform is equal to an area of a bottom surface of the cylinder Z1 having a smaller diameter, and an area of a lower bottom surface of the round platform is equal to an area of a bottom surface of the cylinder Z2 having a larger diameter. The pressing-rivet opening K can be formed by using a pressing-rivet process, and the pressing-rivet opening K is used to prevent an elastically conductive structure 0122 from falling off the conductive sleeve 0121.

Further, in the inner conductor 012 shown in FIG. 3-2 or FIG. 3-5, an axis (not shown in FIG. 3-2 and FIG. 3-5) of the conductive head 01221 is collinear with an axis (not shown in FIG. 3-2 and FIG. 3-5) of the conductive sleeve 0121. As shown in FIG. 3-8, FIG. 3-8 shows a schematic structural diagram of a conductive sleeve 0121. An inner diameter of the conductive sleeve 0121 may be D2. D2 may range in a positive tolerance of 0.02 millimeters. As shown in FIG. 3-9, FIG. 3-9 shows a schematic structural diagram of a conductive head 01221. A diameter of a cylinder having a larger diameter on the conductive head 01221 may be D1. D1 may range in a negative tolerance of 0.02 millimeters. A gap between the cylinder having a larger diameter and the conductive sleeve 0121 may be D. D2, D1, and D satisfy a relationship: D=D2−D1. For example, in this embodiment of the present utility model, the gap between the cylinder having a larger diameter and the conductive sleeve 0121 may be D. A value range of D is 0.01 to 0.05 millimeters. Optionally, D is equal to 0.01 millimeter.

Further, referring to FIG. 3-10, FIG. 3-10 shows a schematic structural diagram of a metal inner core X according to the embodiment shown in FIG. 3-1. Referring to FIG. 3-10, the metal inner core X includes an inner core body X1, and a solid layer X2 and a reinforced conductive layer X3 that are successively disposed on a surface of the metal inner core X. The inner core body X1 may be made of a copper alloy material and formed by means of turning processing. For example, in this embodiment of the present utility model, the copper alloy material may be brass. The solid layer X2 may be made from phosphorous nickel or high phosphorous nickel and formed by using a chemical generation method, where content of phosphorus in phosphorous nickel is generally 6% to 8%, and content of phosphorus in high phosphorus nickel is generally greater than 8%. Nickel is a material having very high hardness, and nickel can be used to improve stiffness of the metal inner core X, but nickel has magnetism. The magnetism affects PIM of a radio frequency connector, and phosphorus can eliminate the magnetism of nickel. Therefore, a solid layer X2 can be made from phosphorous nickel or high phosphorous nickel. In this way, stiffness of the metal inner core X can be ensured while the PIM of the radio frequency connector can be reduced. The reinforced conductive layer X3 may be made of a gold material and formed by using an electroplating process. For example, the reinforced conductive layer X3 is made of gold. Because gold has good electrical conductivity and corrosion resistance, using gold to form the reinforced conductive layer X3 can ensure conductivity of the metal inner core X, and the metal inner core X has corrosion resistance.

Further, referring to FIG. 3-11, FIG. 3-11 shows a schematic structural diagram of a conductive sleeve 0121 according to the embodiment shown in FIG. 3-1. Referring to FIG. 3-11, the conductive sleeve 0121 includes a sleeve body P, and a solid layer P1 and a reinforced conductive layer P2 that are successively disposed on a surface of the sleeve body P. Surfaces of the sleeve body P include an inner surface and an outer surface of the sleeve body P. The sleeve body P may be made of a copper alloy material and formed by means of turning processing. For example, in this embodiment of the present utility model, the copper alloy material may be brass. The solid layer P1 may be made from phosphorous nickel or high phosphorous nickel and formed by using a chemical generation method, where content of phosphorus in phosphorous nickel is generally 6% to 8%, and content of phosphorus in high phosphorus nickel is generally greater than 8%. Nickel is a material having very high hardness, and nickel can be used to improve stiffness of the conductive sleeve 0121, but nickel has magnetism. The magnetism affects PIM of a radio frequency connector, and phosphorus can eliminate the magnetism of nickel. Therefore, the solid layer P1 can be formed by using phosphorous nickel or high phosphorous nickel. In this way, stiffness of the conductive sleeve 0121 can be ensured while the PIM of the radio frequency connector can be reduced. The reinforced conductive layer P2 may be made of a gold material and formed by using an electroplating process. For example, the reinforced conductive layer P2 is made of gold. Because gold has good electrical conductivity and corrosion resistance, using gold to form the reinforced conductive layer P2 can ensure conductivity of the conductive sleeve 0121, and the conductive sleeve 0121 has corrosion resistance.

It should be additionally noted that, according to the radio frequency connector provided in this embodiment of the present utility model, because an inner conductor is disposed in a cavity of an outer conductor, a configuration height of the radio frequency connector is equivalent to a height of the outer conductor. Compared with a radio frequency connector in the prior art, the configuration height of the radio frequency connector is relatively small. Therefore, a thickness of an overall structure that is formed by connecting an antenna module to a transmission and reception module is relatively small.

It should be additionally noted that, a radio frequency connector in the prior art includes a lock end, a middle rod, and a bowl port, whereas the radio frequency connector in this embodiment of the present utility model includes only an outer conductor and an inner conductor, and a structure of the inner conductor is relatively small. Therefore, compared with the prior art, the radio frequency connector provided in this embodiment of the present utility model can reduce materials, and reduce costs of the radio frequency connector. For example, in this embodiment of the present utility model, costs of the radio frequency connector can be as low as 4 RMB.

It should be additionally noted that the radio frequency connector provided in this embodiment of the present utility model has low costs and a small size, and can be quickly inserted or unplugged, and can be applied to a base station used for an alternating-current signal whose frequency ranges from 700 MHz (megahertz) to 6 GHz, and can be configured to transmit a direct-current signal. The radio frequency connector can be applicable to base stations of 2G, 3G, 3.5G, and 6G. This substantially increases competitiveness of the radio frequency connector.

It should be additionally noted that, according to the radio frequency connector provided in this embodiment of the present utility model, the inner conductor has strong radial and axial tolerance capabilities, can implement blind mate, and improve production and equipment test efficiency. In addition, because the inner conductor has a relatively small size, materials used can be reduced, and costs and occupation space of the radio frequency connector can be reduced. In addition, uniqueness and reliability of a contact point between a conductive sleeve and a conductive head can be ensured by disposing an outer insulation layer on the conductive head, so that PIM of the radio frequency connector satisfies a requirement. For example, before the outer insulation layer is added, the PIM of the radio frequency connector is relatively poor. When vibration or knocking is performed on the radio frequency connector, poorest PIM reaches −60 dBm@2*27 dBm. After optimization, when vibration is performed under a force of 10 g or vigorous knocking is performed, the PIM is less than −100 dBm@2*27 dBm.

In conclusion, according to the radio frequency connector provided in this embodiment of the present utility model, because an outer conductor can be fixedly connected to an antenna PCB and a transceiving PCB, an inner conductor can be welded on the transceiving PCB and abut against the antenna PCB, connection between the transceiving PCB, the radio frequency connector, and the antenna PCB can be implemented without insertion and buckling. Therefore, a problem that a radio frequency connector is easily damaged because alignment cannot be implemented can be avoided, and damage to the radio frequency connector can be reduced.

The radio frequency connector provided in this embodiment of the present utility model can be applied to a method in the following description, and for a use method of the radio frequency connector in this embodiment of the present utility model, reference may be made to descriptions of the following embodiments.

Referring to FIG. 4, FIG. 4 shows a method flowchart of a use method of a radio frequency connector according to an embodiment of the present utility model. The use method is used for the radio frequency connector shown in FIG. 2 or FIG. 3-1. Referring to FIG. 4, the use method of the radio frequency connector may include the following steps.

Step 401: Weld a closed end of a conductive sleeve of an inner conductor of the radio frequency connector on a transceiving printed circuit board PCB.

Step 402: Fixedly connect an outer conductor of the radio frequency connector to both an antenna PCB and the transceiving PCB, so that a part, extending out from an open end of the conductive sleeve, of an elastically conductive structure of the inner conductor abuts against the antenna PCB.

In conclusion, according to the use method of the radio frequency connector provided in this embodiment of the present utility model, because an outer conductor can be fixedly connected to an antenna PCB and a transceiving PCB, an inner conductor can be welded on the transceiving PCB and abut against the antenna PCB, connection between the transceiving PCB, the radio frequency connector, and the antenna PCB can be implemented without insertion and buckling. Therefore, a problem that a radio frequency connector is easily damaged because alignment cannot be implemented can be avoided, and damage to the radio frequency connector can be avoided.

Optionally, before step 401, the use method of the radio frequency connector may further include:

inserting the inner conductor of the radio frequency connector into a fixing hole in the transceiving PCB by using a fixing piece at the closed end of the conductive sleeve.

Step 402 may include: fixedly connecting the outer conductor of the radio frequency connector to both the antenna PCB and the transceiving PCB by using screws, so that the part, extending out from the open end of the conductive sleeve, of the elastically conductive structure of the inner conductor abuts against the antenna PCB.

All foregoing optional technical solutions may be combined in any form to form an optional embodiment of the present utility model, and details are not described herein.

In conclusion, according to the use method of the radio frequency connector provided in this embodiment of the present utility model, because an outer conductor can be fixedly connected to an antenna PCB and a transceiving PCB, an inner conductor can be welded on the transceiving PCB and abut against the antenna PCB, connection between the transceiving PCB, the radio frequency connector, and the antenna PCB can be implemented without insertion and buckling. Therefore, a problem that a radio frequency connector is easily damaged because alignment cannot be implemented can be avoided, and damage to the radio frequency connector can be reduced.

Referring to FIG. 5-1, FIG. 5-1 shows a method flowchart of a use method of a radio frequency connector according to another embodiment of the present utility model. The use method is used for the radio frequency connector shown in FIG. 2 or FIG. 3-1. Referring to FIG. 5-1, the use method of the radio frequency connector may include the following steps.

Step 501: Insert an inner conductor of the radio frequency connector into a fixing hole in a transceiving printed circuit board PCB by using a fixing piece at a closed end of a conductive sleeve.

For example, in this embodiment of the present utility model, a bonding pad may be disposed on the transceiving PCB, and a fixing hole may be disposed in a location of the bonding pad. As shown in FIG. 3-1, a fixing piece 01211 is disposed at a closed end of a conductive sleeve 0121 of an inner conductor 012 of a radio frequency connector 01. The fixing piece 01211 may be inserted into a fixing hole in a transceiving PCB. Therefore, when the radio frequency connector and the transceiving PCB are installed, the fixing piece 01211 at the closed end of the conductive sleeve 0121 may be inserted into the fixing hole in the transceiving PCB. In this way, misalignment between the closed end of the conductive sleeve 0121 and the bonding pad on the transceiving PCB caused when the conductive sleeve 0121 and the transceiving PCB are welded can be avoided. It should be noted that, in actual application, the fixing piece 01211 may be a welding pin, and the fixing hole in the transceiving PCB may be a welding through hole. The welding pin on the conductive sleeve 0121 may be inserted into the welding through hole in the transceiving PCB.

Step 502: Weld the closed end of the conductive sleeve of the inner conductor of the radio frequency connector on the transceiving PCB.

For example, the closed end of the conductive sleeve 0121 of the inner conductor 012 of the radio frequency connector 01 may be welded on the transceiving PCB by using a through-hole reflow soldering process, and a schematic structural diagram illustrated after the closed end of the conductive sleeve 0121 of the inner conductor 012 of the radio frequency connector 01 is welded on the transceiving PCB may be shown in FIG. 5-2.

Step 503: Fixedly connect an outer conductor of the radio frequency connector to both an antenna PCB and the transceiving PCB, so that a part, extending out from an open end of the conductive sleeve, of an elastically conductive structure of the inner conductor abuts against the antenna PCB.

For example, an outer conductor 011 of the radio frequency connector 01 may be fixedly connected to both an antenna PCB and the transceiving PCB by using screws, so that a part, extending out from an open end of the conductive sleeve 01221, of an elastically conductive structure 0122 of the inner conductor 012 abuts against the antenna PCB. A schematic structural diagram illustrated after the outer conductor 011 of the radio frequency connector 01 is fixedly connected to both the antenna PCB and the transceiving PCB may be shown in FIG. 5-3. Referring to FIG. 5-3, under an action of an elastic element 01222 of the elastically conductive structure 0122, a conductive head 01221 abuts against the antenna PCB. It should be noted that, in actual application, a bonding pad is disposed on the antenna PCB, and under an action of the elastic element 01222 of the elastically conductive structure 0122, the conductive head 01221 abuts against the bonding pad of the antenna PCB.

FIG. 5-2 provides descriptions by using an example in which an included angle a is less than 90°. In this case, a working signal of a base station is a direct-current signal or an alternating-current signal whose frequency is less than 6 GHz. A signal on the transceiving PCB is transmitted to the conductive head 01221 through the conductive sleeve 0121 and through a contact point between the conductive sleeve 0121 and the conductive head 01221 of the elastically conductive structure 0122, and transmitted to the antenna PCB through the conductive head 01221.

It should be noted that when the included angle a is equal to 90°, the working signal of the base station may be a high frequency signal whose frequency is 1.7 GHz to 6 GHz. A signal on the transceiving PCB is transmitted to the conductive head 01221 of the elastically conductive structure 0122 by means of coupling, and transmitted to the antenna PCB through the conductive head 01221.

In conclusion, according to the use method of the radio frequency connector provided in this embodiment of the present utility model, because an outer conductor can be fixedly connected to an antenna PCB and a transceiving PCB, an inner conductor can be welded on the transceiving PCB and abut against the antenna PCB, connection between the transceiving PCB, the radio frequency connector, and the antenna PCB can be implemented without insertion and buckling. Therefore, a problem that a radio frequency connector is easily damaged because alignment cannot be implemented can be avoided, and damage to the radio frequency connector can be reduced.

Figures 3, 4, 5, 6:
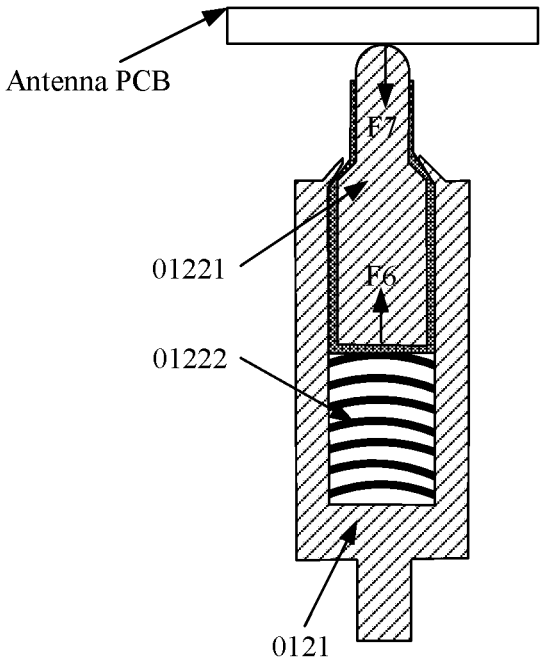
Figures 3, 4, 5, 6, 7:
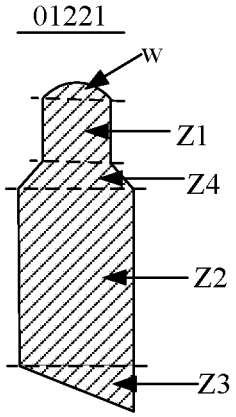
Figures 3, 4, 5, 6, 7, 8:
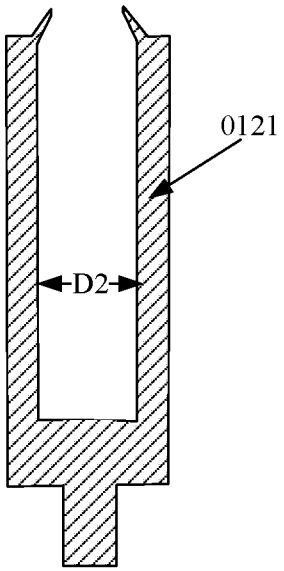
Figures 3, 4, 5, 6, 7, 8, 9:
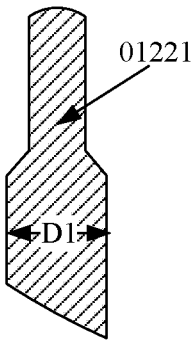
Figures 3, 4, 5, 6, 7, 8, 9, 10:
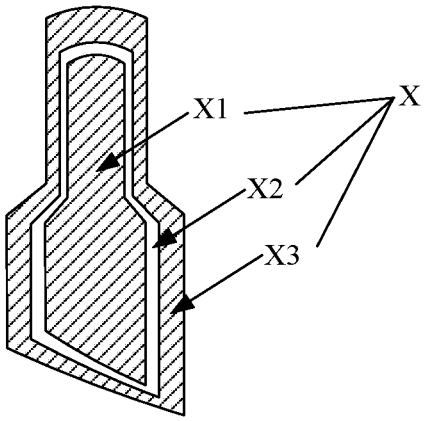
Figures 3, 4, 5, 6, 7, 8, 9, 10, 11:
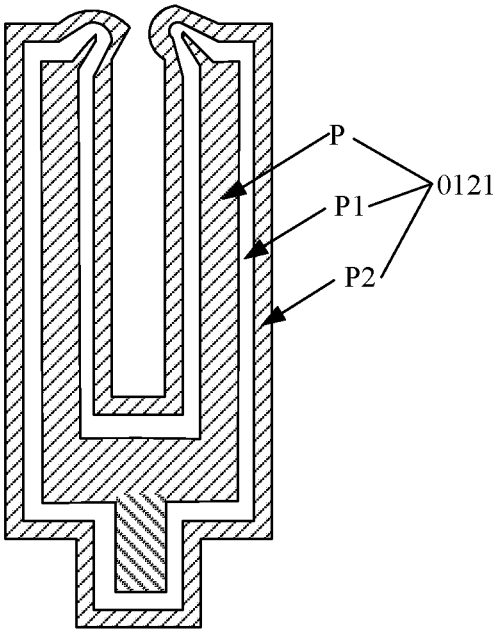
Figure 4:
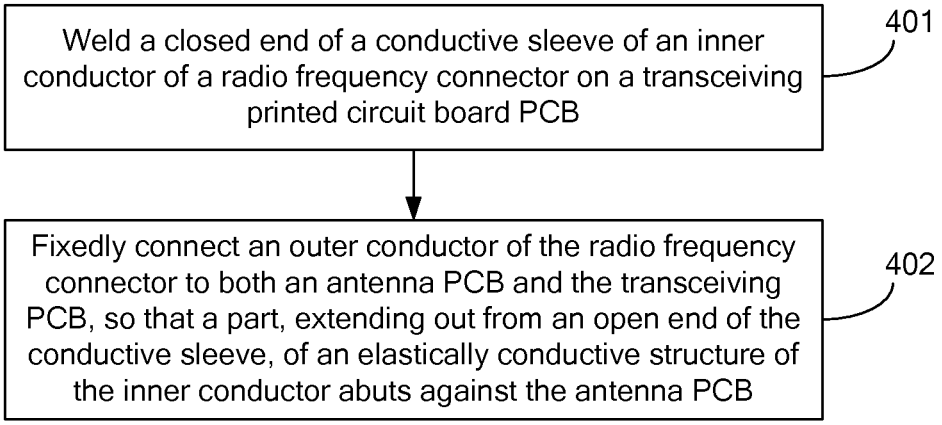
Figures 1, 5:
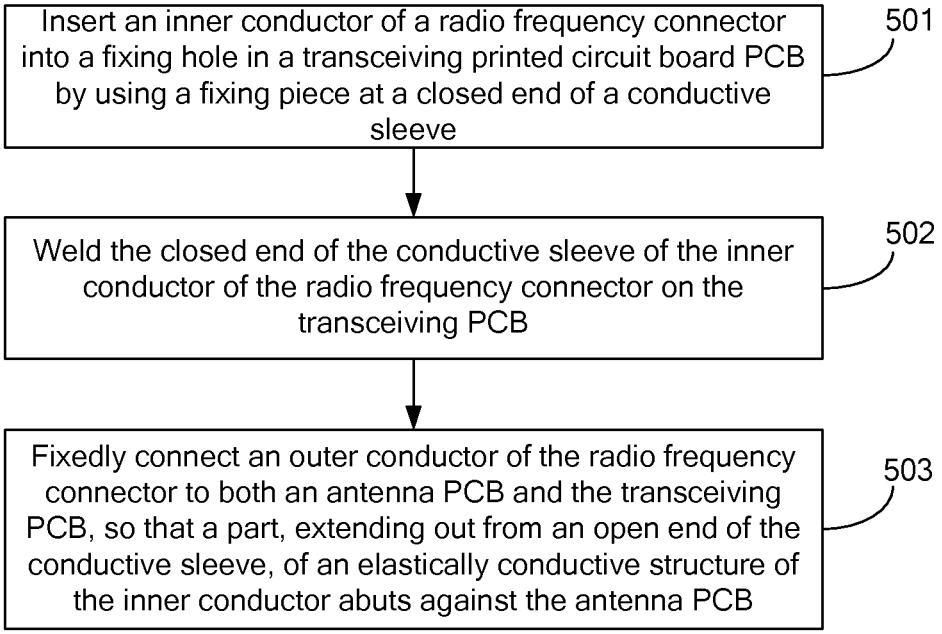
Figures 2, 5:
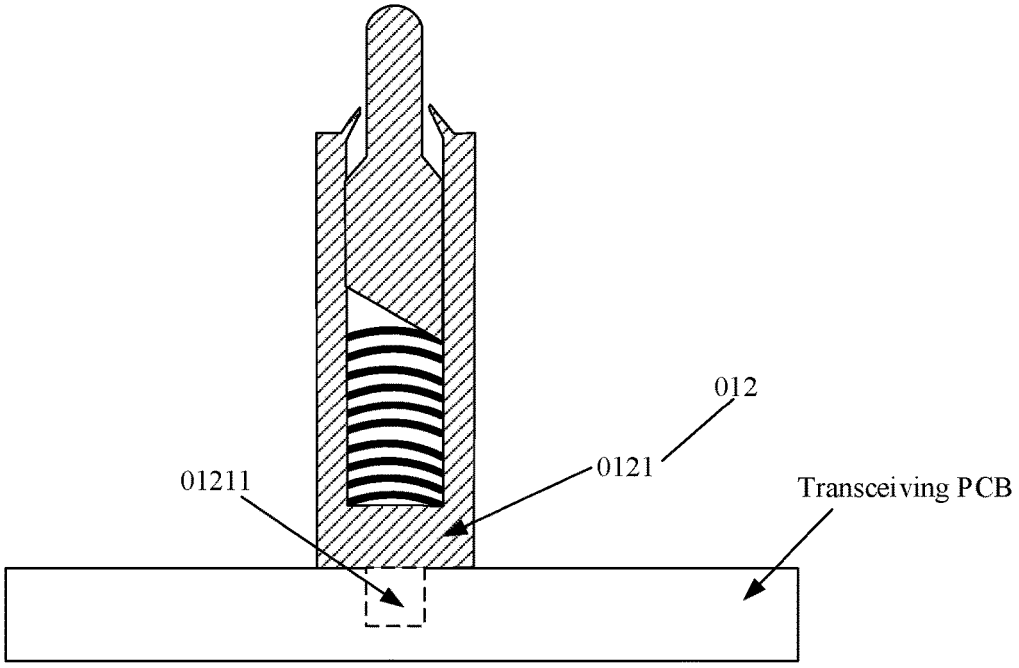
Figures 3, 5:
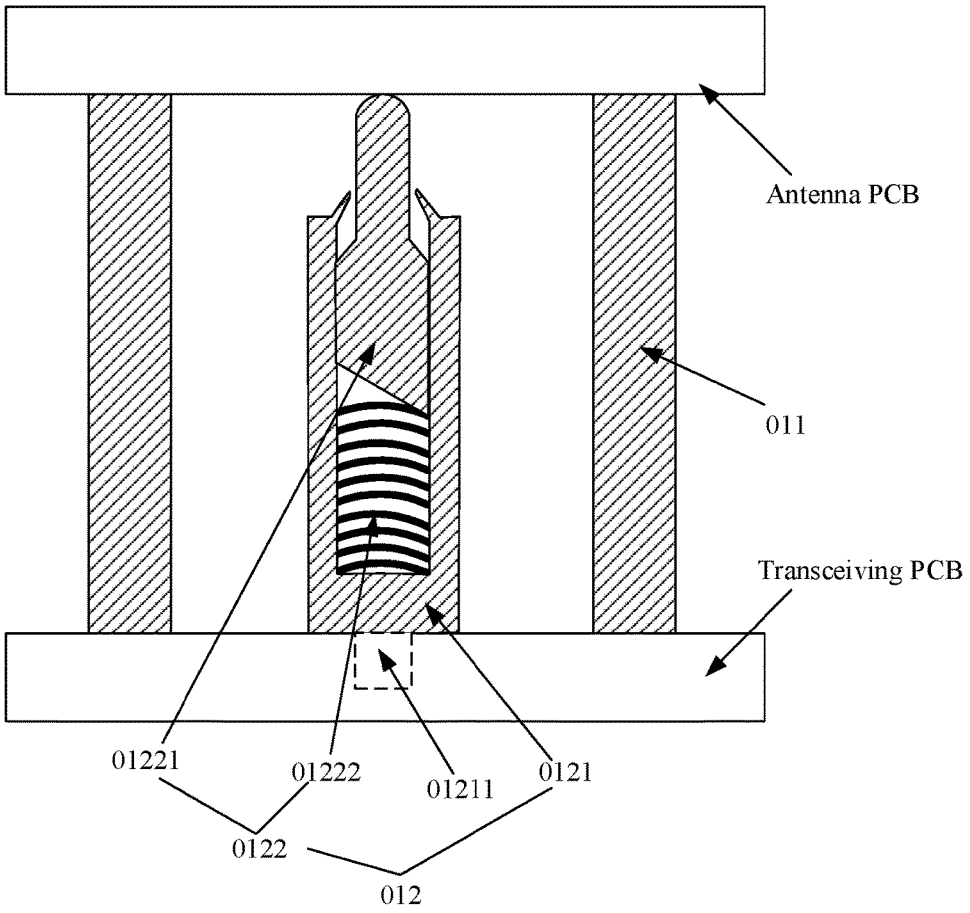
Figures 1, 6:
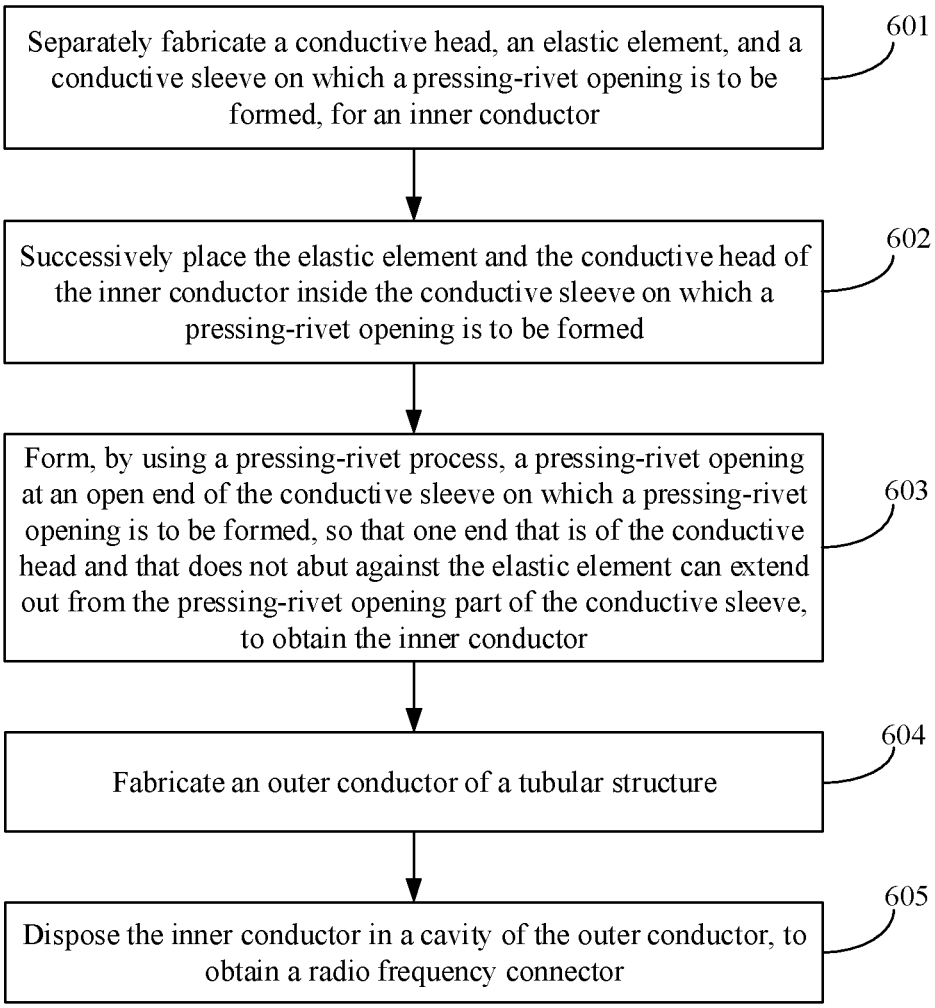
Figures 2, 6:
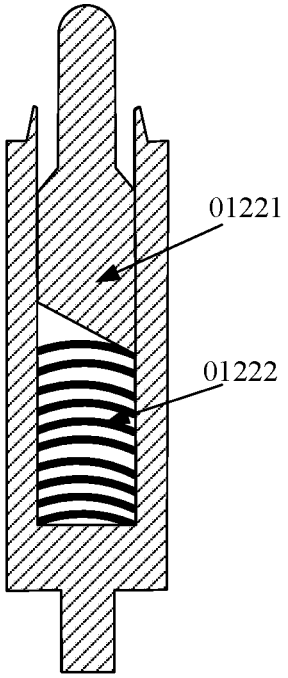

Referring to FIG. 6-1, FIG. 6-1 shows a method flowchart of a method for fabricating a radio frequency connector according to an embodiment of the present utility model. The method for fabricating a radio frequency connector can be used to fabricate the radio frequency connector shown in FIG. 2 or FIG. 3-1. Referring to FIG. 6-1, the method for fabricating a radio frequency connector may include the following steps.

Step 601: Separately fabricate a conductive head, an elastic element, and a conductive sleeve on which a pressing-rivet opening is to be formed, for an inner conductor.

As shown in FIG. 3-2 or FIG. 3-5, a conductive head 01221 may include a metal inner core X and an outer insulation layer Y. Therefore, fabricating the conductive head 01221 may include fabricating the metal inner core X, and forming the outer insulation layer Y on the metal inner core X. Referring to FIG. 3-10, it can be learned that a metal inner core X includes an inner core body X1, and a solid layer X2 and a reinforced conductive layer X3 that are successively disposed on a surface of the inner core body X1. Therefore, fabricating the metal inner core X includes fabricating the inner core body X1, and forming the solid layer X2 and the reinforced conductive layer X3 on the inner core body X1 successively. For example, in this embodiment of the present utility model, the inner core body X1 may be made of a copper alloy material and formed by means of turning processing. Then, the solid layer X2 is formed on a surface of the inner core body X1 by using phosphorous nickel or high phosphorous nickel as a material and by using a chemical generation method. Then, the reinforced conductive layer X3 is formed on the solid layer X2 by using gold as a material and by using an electroplating process, to obtain the metal inner core X. A schematic structural diagram of the metal inner core X may be shown in FIG. 3-10. After the metal inner core X is formed, an outer insulation layer Y may be formed on the metal inner core X by using PEEK or PTFE as a material. For example, a forming process of the outer insulation layer Y may include spraying or embedding, that is, spraying an insulation material on a surface of the metal inner core X, or embedding, by using an embedding process, a structure formed by PEEK or PTFE into the surface of the metal inner core X. This embodiment of the present utility model is not limited thereto.

For a procedure for fabricating the elastic element, refer to the prior art, and details are not described in this embodiment of the present utility model.

Referring to FIG. 3-11, it can be learned that a conductive sleeve 0121 may include a sleeve body P, and a solid layer P1 and a reinforced conductive layer P2 that are successively disposed on a surface of the sleeve body P. Therefore, fabricating a conductive sleeve on which a pressing-rivet opening is to be formed may include fabricating a sleeve body on which a pressing-rivet opening is to be formed, and successively forming a solid layer and a reinforced conductive layer on a surface of the sleeve body on which a pressing-rivet opening is to be formed. Surfaces of the sleeve body P on which a pressing-rivet opening is to be formed include an inner surface and an outer surface. For example, in this embodiment of the present utility model, the sleeve body on which a pressing-rivet opening is to be formed may be made of a copper alloy material and formed by means of turning processing. Then, the solid layer is formed, by using phosphorous nickel or high phosphorous nickel as a material and by using a chemical generation method, on the surface of the sleeve body on which a pressing-rivet opening is to be formed. Then, the reinforced conductive layer is formed on the solid layer by using gold as a material and by using an electroplating process, to obtain the sleeve body, on which a pressing-rivet opening is to be formed, of the conductive sleeve.

Step 602: Successively place the elastic element and the conductive head of the inner conductor inside the conductive sleeve on which a pressing-rivet opening is to be formed.

For example, a schematic structural diagram illustrated after an elastic element 01222 and the conductive head 01221 are successively placed inside a conductive sleeve on which a pressing-rivet opening is to be formed may be shown in FIG. 6-2. The sleeve body on which a pressing-rivet opening is to be formed, the solid layer, and the reinforced conductive layer are not distinguished in FIG. 6-2.

Step 603: Form, by using a pressing-rivet process, a pressing-rivet opening at an open end of the conductive sleeve on which a pressing-rivet opening is to be formed, so that one end that is of the conductive head and that does not abut against the elastic element can extend out from the pressing-rivet opening part of the conductive sleeve, to obtain the inner conductor.

For example, a schematic structural diagram illustrated after the pressing-rivet opening is formed at the open end of the conductive sleeve on which a pressing-rivet opening is to be formed may be shown in FIG. 3-2.

Step 604: Fabricate an outer conductor of a tubular structure.

The outer conductor may be made of metal aluminum and formed by means of turning processing. Details are not described in this embodiment of the present utility model.

Step 605: Dispose the inner conductor in a cavity of the outer conductor, to obtain a radio frequency connector.

For example, a structure of the radio frequency connector may be shown in FIG. 3-1.

In conclusion, according to the method for fabricating a radio frequency connector provided in this embodiment of the present utility model, because an outer conductor can be fixedly connected to an antenna PCB and a transceiving PCB, an inner conductor can be welded on the transceiving PCB and abut against the antenna PCB, connection between the transceiving PCB, the radio frequency connector, and the antenna PCB can be implemented without insertion and buckling. Therefore, a problem that a radio frequency connector is easily damaged because alignment cannot be implemented can be avoided, and damage to the radio frequency connector can be reduced.

A person of ordinary skill in the art may understand that all or some of the steps of the embodiments may be implemented by hardware or a program instructing related hardware. The program may be stored in a computer-readable storage medium. The storage medium may include: a read-only memory, a magnetic disk, or an optical disc.

The foregoing descriptions are merely exemplary embodiments of the present utility model, but are not intended to limit the present utility model. Any modification, equivalent replacement, and improvement made without departing from the spirit and principle of the present utility model shall fall within the protection scope of the present utility model.

What is claimed is:

1. A radio frequency connector, wherein the radio frequency connector comprises:

an outer conductor and an inner conductor, wherein the inner conductor comprises a conductive sleeve and an elastically conductive structure, wherein the outer conductor is a tubular structure, the inner conductor is disposed in a cavity of the outer conductor, and the inner conductor is not in contact with the outer conductor;

one end of the conductive sleeve is open, and the other end of the conductive sleeve is closed; the elastically conductive structure is disposed inside the conductive sleeve; one end of the elastically conductive structure abuts against the closed end of the conductive sleeve, and the other end of the elastically conductive structure extends out from the open end part of the conductive sleeve, and is movable in a height direction of the conductive sleeve; and the outer conductor is configured to be fixedly connected to both an antenna printed circuit board (PCB) and a transceiving PCB; the closed end of the conductive sleeve is configured to be welded on the transceiving PCB; and the part, extending out from the open end of the conductive sleeve, of the elastically conductive structure is configured to abut against the antenna PCB.

2. The radio frequency connector according to claim 1, wherein the elastically conductive structure comprises a conductive head and an elastic element, wherein one end of the elastic element abuts against the closed end of the conductive sleeve; a bottom end of the conductive head abuts against the other end of the elastic element; and a top end of the conductive head is configured to extend out from the open end part of the conductive sleeve.

3. The radio frequency connector according to claim 2, wherein the conductive head comprises a metal inner core and an outer insulation layer, wherein the metal inner core is of a columnar structure, an included angle a exists between a bottom surface and a side surface of the metal inner core, and a value range of a is $0° < a \leq 90°$, wherein when a is less than 90°, the outer insulation layer is disposed on the side surface of the metal inner core, a region that is on the side surface of the metal inner core and that is close to the bottom surface of the metal inner core is an exposed region in which the outer insulation layer is not disposed, and the exposed region is configured to be in point contact with an inner wall of the conductive sleeve under an action of the elastic element; and when a is equal to 90°, the outer insulation layer is disposed on both the bottom surface and the side surface of the metal inner core, and the conductive head and the conductive sleeve are coupled for signal transmission.

4. The radio frequency connector according to claim 3, wherein the conductive head is of an integrated structure formed by superimposing bottom surfaces of two cylinders having unequal diameters; an axis of the cylinder having a smaller diameter is collinear with an axis of the cylinder having a larger diameter; and a curved surface protrusion is disposed on a bottom surface that is of the cylinder having a smaller diameter and that is not superimposed with the cylinder having a larger diameter; and the conductive sleeve is a cylindrical sleeve, a pressing-rivet opening is disposed at an open end of the conductive sleeve, and one end having a smaller diameter of the conductive head is configured to extend out from the pressing-rivet opening of the conductive sleeve.

5. The radio frequency connector according to claim 4, wherein an axis of the conductive head is collinear with an axis of the conductive sleeve, an inner diameter of the conductive sleeve is D2, a diameter of the cylinder having a larger diameter is D1, and a gap between the cylinder having a larger diameter and the conductive sleeve is D, wherein D2, D1, and D satisfy a relationship: $D=D2-D1$.

6. The radio frequency connector according to claim 5, wherein

D2 ranges in a positive tolerance of 0.02 millimeters, D1 ranges in a negative tolerance of 0.02 millimeters, and a value range of D is 0.01 to 0.05 millimeters.

7. The radio frequency connector according to claim 6, wherein

D is equal to 0.01 millimeter.

8. The radio frequency connector according to claim 1, wherein a fixing piece is disposed at the closed end of the conductive sleeve, a fixing hole is disposed on the transceiving PCB, and the fixing piece is configured to be inserted into the fixing hole; and the outer conductor is configured to be fixedly connected to both the antenna PCB and the transceiving PCB by using screws.

9. The radio frequency connector according to claim 2, wherein the elastic element is a compression spring.

10. The radio frequency connector according to claim 3, wherein the metal inner core comprises an inner core body, and a solid layer and a reinforced conductive layer that are successively disposed on a surface of the inner core body; and the conductive sleeve comprises a sleeve body, and a solid layer and a reinforced conductive layer that are successively disposed on a surface of the sleeve body;

both the inner core body and the sleeve body are made of a copper alloy material and formed by means of turning processing;

the solid layer is made from phosphorous nickel or high phosphorous nickel and formed by using a chemical generation method;

the reinforced conductive layer is made of a gold material and formed by using an electroplating process; and a forming material of the outer insulation layer comprises either polytetrafluorethylene or polyetheretherketone.

* * * * *